United States Patent [19]

Toy et al.

[11] 4,388,607

[45] Jun. 14, 1983

[54] CONDUCTIVE POLYMER COMPOSITIONS, AND TO DEVICES COMPRISING SUCH COMPOSITIONS

[75] Inventors: Lester T. Toy, San Francisco; Wendell W. Moyer; Bernard J. Lyons, both of Atherton; David A. Horsma, Palo Alto, all of Calif.

[73] Assignee: Raychem Corporation, Menlo Park, Calif.

[21] Appl. No.: 85,679

[22] Filed: Oct. 17, 1979

Related U.S. Application Data

[63] Continuation of Ser. No. 909,971, May 26, 1978, abandoned, which is a continuation of Ser. No. 751,095, Dec. 16, 1976, abandoned, and a continuation of Ser. No. 909,970, May 26, 1978.

[51] Int. Cl.[3] ..... H01B 1/04; H01C 7/13

[52] U.S. Cl. ..... 338/22 SD; 219/549; 219/553; 252/511

[58] Field of Search ..... 338/22 R, 22 SD, 25; 219/553, 548, 549; 252/511

[56] References Cited

U.S. PATENT DOCUMENTS

| | | | |
|---|---|---|---|
| 601,424 | 8/1875 | Moyer . | |
| 790,977 | 4/1877 | Moyer . | |
| 3,243,753 | 3/1966 | Kohler . | |
| 3,567,607 | 3/1971 | Saunders et al. . | |
| 3,591,526 | 7/1971 | Kawashima et al. . | |
| 3,673,121 | 6/1972 | Meyer . | |
| 3,689,736 | 9/1972 | Meyer . | |
| 3,793,716 | 2/1974 | Smith-Johannsen . | |
| 3,849,333 | 11/1974 | Lloyd et al. | 252/511 |
| 3,861,029 | 1/1975 | Smith-Johannsen et al. . | |
| 3,914,363 | 10/1975 | Bedard et al. . | |
| 4,017,715 | 4/1977 | Whitney et al. | 338/22 R X |
| 4,188,276 | 2/1980 | Lyons et al. | 219/549 X |
| 4,304,987 | 12/1981 | Vankonynenburg | 219/553 |

FOREIGN PATENT DOCUMENTS

| | | |
|---|---|---|
| 1219674 | 6/1966 | Fed. Rep. of Germany . |
| 1332065 | 6/1963 | France . |
| 2077021 | 10/1971 | France . |
| 2199172 | 4/1974 | France . |
| 2321751 | 3/1977 | France . |
| 49-82734 | 8/1974 | Japan . |
| 49-82735 | 8/1974 | Japan . |
| 49-82763 | 8/1974 | Japan . |
| 931999 | 7/1963 | United Kingdom . |
| 942789 | 11/1963 | United Kingdom . |

OTHER PUBLICATIONS

Union Carbide Product Data Sheet, F–42922, "Bakelite Semiconductive Ethylene Copolymer, DHDA 7702 Black 55 for Wire and Cable".

Union Carbide Product Data Sheet, F–45621, "Bakelite DHDA–7704 Black 55".

*Primary Examiner*—B. A. Reynolds

*Attorney, Agent, or Firm*—Lyon & Lyon

[57] ABSTRACT

Conductive polymer compositions which have improved voltage stability and which preferably exhibit PTC behavior. The compositions comprise a carbon black dispersed in a crystalline copolymer of an olefin and at least 10% by weight of an olefinically unsaturated comonomer containing a polar group. The carbon black has a particle size greater than 18 millimicrons, preferably greater than 30 millimicrons, a d-spacing greater than 360 and a surface area which is less than $$1.2S+e^{S/50}$$

where S is the DBP absorption of the carbon black. The carbon black is preferably present in amount at least 15% by weight of the composition. Particularly useful devices including such compositions are self-regulating heaters.

49 Claims, 1 Drawing Figure

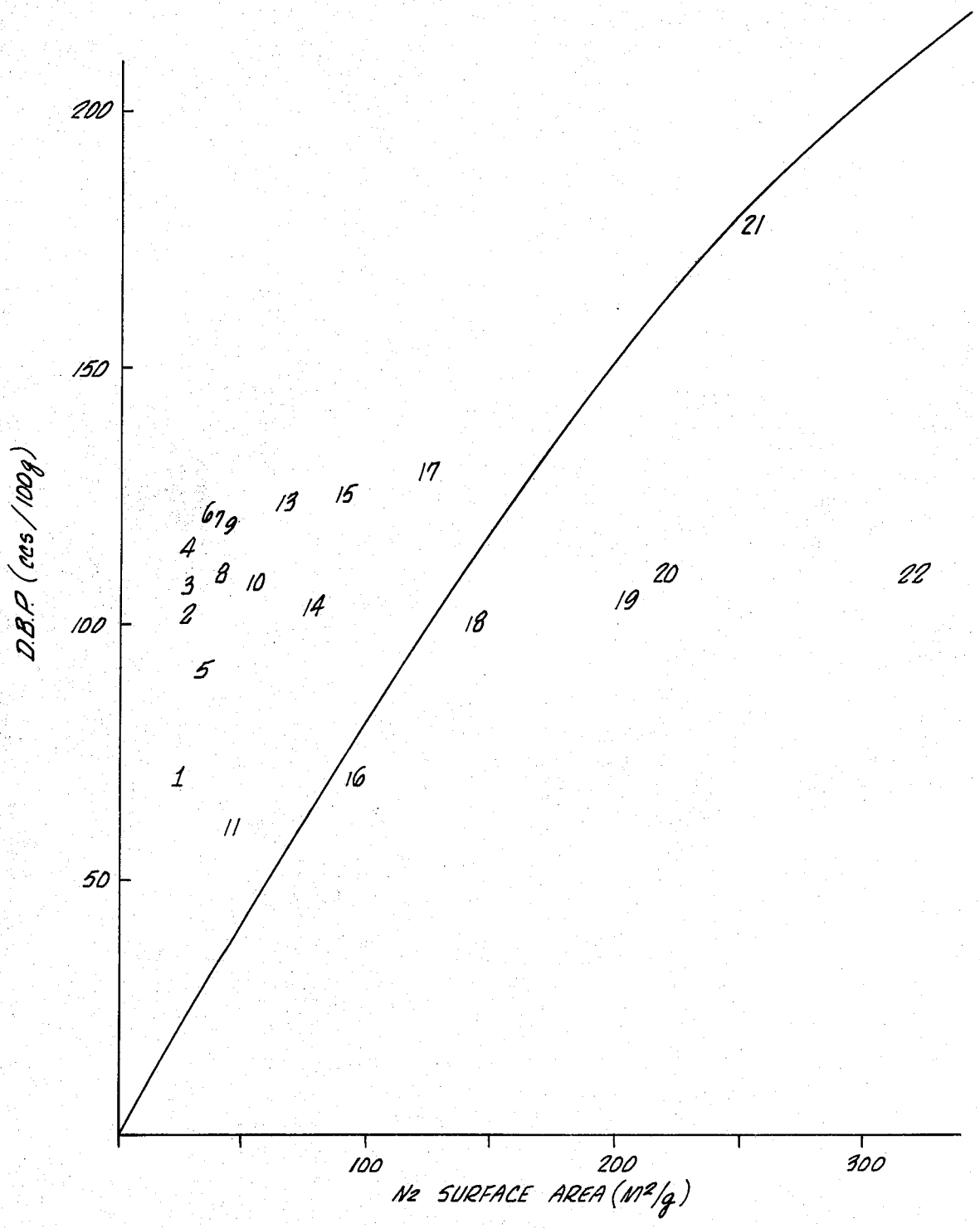
200
150
100
50
D.B.P. (cc's/100g)
100
200
300
N2 SURFACE AREA (M²/g)
1
2
3
4
5
6
7
8
9
10
11
13
14
15
16
17
18
19
20
21
22

CONDUCTIVE POLYMER COMPOSITIONS, AND TO DEVICES COMPRISING SUCH COMPOSITIONS

CROSS REFERENCE TO RELATED APPLICATIONS

The application is a continuation of application Ser. No. 909,971 filed May 26, 1978 (now abandoned), which is a continuation of application Ser. No. 751,095 filed Dec. 16, 1976 (now abandoned). This is a continuation of application Ser. No. 909,970, filed May 26, 1978.

BACKGROUND OF THE INVENTION

1. Field of the Invention

This invention relates to conductive polymer compositions, and to devices comprising such compositions.

SUMMARY OF THE PRIOR ART

It is known that polymers, including crystalline polymers and natural rubbers and other elastomers, can be made electrically conductive by dispersing therein suitable amounts of finely divided conductive fillers, e.g. carbon black. For a general survey of such materials (which are usually known as conductive polymers), reference may be made to "Conductive Rubbers and Plastics" by R. H. Norman, published in 1970 by Elsevier Publishing Co. It is also known that the electrical properties of conductive polymers frequently depend upon, inter alia, their temperature; and that a very small proportion of conductive polymers exhibit what is known as PTC (positive temperature coefficient) behavior, i.e., a rapid increase in resistivity at a particular temperature or over a particular temperature range. The term "switching temperature" (usually abbreviated to $T_s$) is used to denote the temperature at which the rapid increase takes place. When the increase takes place over a temperature range (as is often the case) then $T_s$ can conveniently be designated as the temperature at which extensions of the substantially straight portions of the plot of the log of the resistance against the temperature (above and below the range) cross. The resistance of PTC polymers continues to increase as the temperature rises above $T_s$ until it reaches a maximum, called the Peak Resistance, at a temperature which is called the Peak Temperature; the resistance thereafter decreases more or less rapidly.

Materials exhibiting PTC behavior are useful in a number of applications in which the size of the current passing through a circuit is controlled by the temperature of a PTC element forming part of that circuit. For practical purposes, the volume resistivity of the material at temperatures below $T_s$ should be less than about $10^5$ ohm.cm, and the increase in resistance above $T_s$ should be sufficiently high that the material is effectively converted from an electrical conductor to an electrical insulator by a relatively limited increase in temperature. A convenient expression of this requirement is that the material should have an $R_{14}$ value of at least 2.5 or an $R_{100}$ value of at least 10, and preferably an $R_{30}$ value of at least 6, where $R_{14}$ is the ratio of the resistivities at the end and beginning of the 14° C. range showing the sharpest increase in resistivity; $R_{100}$ is the ratio of the resistivities at the end and beginning of the 100° C. range showing the sharpest increase in resistivity; and $R_{30}$ is the ratio of the resistivities at the end and beginning of the 30° C. range showing the sharpest increase in resistivity. A further practical requirement for most PTC materials is that they should continue to exhibit useful PTC behavior, with $T_s$ remaining substantially unchanged, when repeatedly subjected to thermal cycling which comprises heating the material from a temperature below $T_s$ to a temperature above $T_s$ but below the peak temperature, followed by cooling to a temperature below $T_s$. It is also preferred that the ratio of the peak resistance to the resistance at $T_s$ should be at least 20:1, especially at least 100:1.

Having regard to these practical limitations, it has been accepted in the art that in a conductive polymer composition exhibiting useful PTC behavior, the polymer must be a thermoplastic crystalline polymer. Thus PTC compositions comprising a thermoplastic crystalline polymer with carbon black dispersed therein have been used in self-regulating strip heaters. The polymers which have been used include polyolefins, e.g. polyethylene, and copolymers of olefins and polar comonomers, e.g. ethylene/ethyl acrylate copolymers. Such compositions show a rapid increase in resistance over a range which begins at the softening point of the polymer and has a $T_s$ at or near the crystalline melting point of the polymer; the greater the crystallinity of the polymer, the smaller the temperature range over which the resistance increase takes place. Generally, the composition is cross-linked, preferably by irradiation at room temperature, to improve its stability at temperatures above $T_s$.

For details of prior disclosures of conductive polymer compositions exhibiting PTC behavior, reference should be made to U.S. Pat. Nos. 2,978,665; 3,243,753; 3,412,358; 3,591,526; 3,793,716; 3,823,217; 3,849,333 and 3,914,363; British Pat. No. 1,409,695; Brit. J. Appl. Phys, Series 2, 2, 567–576 (1969, Carley Read and Stow); Kautschuk und Gummi II WT 138–148 (1958, de Meij); and Polymer Engineering and Science, November 1973, 13, 462–468 (J. Meyer), the disclosures of which are hereby incorporated by reference. For details of recent developments in this field, reference may be made to U.S. Patent Applications Serial Nos. 601,638, (now Pat. No. 4,177,376) 601,427, (now Pat. No. 4,017,715) 601,549 (now abandoned), and 601,344 (now Pat. No. 4,085,286) (all filed Aug. 4, 1975), 638,440 (now abandoned) and 638,687 (now abandoned) (both filed Dec. 8, 1975), the application filed July 19, 1976 by Kamath and Leder and entitled "Improved PTC Strip Heater", Serial No. 706,602 (now abandoned), and 732,792 (now abandoned) filed Oct. 15, 1976, the disclosures of which are hereby incorporated by reference.

Carbon blacks vary widely in their ability to impart conductivity to polymers with which they are mixed, and mixtures of polymers and carbon blacks generally have poor physical properties when the proportion of carbon black becomes too high, e.g. above 30% to 50%, depending on the polymer (percentages are by weight throughout this specification). Not surprisingly, therefore, only a very limited number of carbon blacks have been used or recommended for use in conductive polymer compositions, i.e. compositions whose utility depends upon their electrical characteristics. The carbon blacks in question are, of course, those which have been recognised to have the ability to impart high conductivity, for example acetylene blacks (the only acetylene black commercially available in the United States at present being Shawinigan acetylene black, produced by Shawinigan Resin Co., a Canadian company), and various furnace blacks, such as Vulcan XC-72 and Vulcan SC (both sold by Cabot corporation), which are characterised by high surface area (as measured by nitrogen absorption) and high structure (as measured by dibutyl phthalate absorption). The latter three parameters are those usually used to characterise carbon blacks, and for details of how they are measured, reference should be made to "Analysis of Carbon Black" by Schubert, Ford and Lyon, Vol. 8, Encyclopedia of Industrial Chemical Analysis (1969), 179, published by John Wiley & Son, New York. For details of the nomenclature used in the carbon black industry, reference should be made to ASTM standard D 1765-67. Another characterising property of a carbon black is its d-spacing (the average distance in pico-meters between adjacent graphitic planes in the carbon black); thus acetylene black has a substantially smaller d-spacing (less than 360, typically about 355) than other carbon blacks. The d-spacings given herein are measured by electron microscopy. For further details reference may be made to "Carbon Black" by Donnet and Voet, published by Marcel Dekker Inc., New York (1976).

The conductivity of conductive polymers containing carbon black can be increased by annealing, e.g. as described in U.S. Pat. Nos. 3,861,029 and 3,914,363. By making use of this annealing procedure, it is possible to prepare PTC compositions which contain less than 15% of carbon black but which have satisfactory initial conductivity, for example for use in strip heaters.

A serious problem that arises with conductive polymers, particularly those exhibiting useful PTC behavior, is lack of voltage stability, i.e. a tendency for the resistivity to rise irreversibly when the composition is subjected to voltages greater than about 110 volts, e.g. 220 or 480 volts AC, at a rate which is dependent on the voltage. This problem is particularly serious with heating devices, because the rise in resistance results in corresponding loss in power output. Although voltage instability is a serious problem, it appears not to have been recognized as such in the prior art. U.S. Application Ser. No. 601,550 (now Pat. No. 4,188,276) is concerned with improving the voltage stability of PTC compositions comprising carbon black dispersed in a polymer containing fluorine, e.g. polyvinylidene fluoride, by cross-linking the composition with an unsaturated monomer. However, this expedient does not yield improved voltage stability with other polymers.

SUMMARY OF THE INVENTION

We have now discovered that improved voltage stability is posessed by a cross-linked conductive polymer composition which comprises (a) a conductive carbon black having a particle size greater than 18 millimicrons, a d-spacing greater than 360, and a surface area (A) which is less than $$1.2S+e^{S/50}$$

where S is the DBP adsorption of the carbon black, said carbon black being dispersed in (b) at least one crystalline copolymer which consists essentially of units derived from at least one olefin and at least 10 weight %, based on the copolymer, of units derived from at least one olefinically unsaturated comonomer containing a polar group, said composition having a gel fraction of at least 0.6 when said crystalline copolymer has a melt index of more than 20 and $$2L+5\log_{10}R\leqq 45$$

where L is the content of carbon black in percent by weight based on the weight of the composition; and R is the resistivity of the composition at 25° C. in ohm.cm. Preferably the carbon-black-containing copolymer is dispersed in a second polymer which serves as a matrix therefor. The matrix polymer is preferably substantially free of carbon black but may contain a relatively small proportion of carbon black, e.g. by migration from the copolymer, such that the resistance/temperature characteristics of the composition are dominated by the carbon-black-containing copolymer. The compositions of the invention preferably exhibit useful PTC behavior as described above. The invention includes processes in which a master batch of the carbon black in the copolymer is dispersed in a matrix polymer, and the mixture is cross-linked, optionally after annealing.

BRIEF DESCRIPTION OF THE DRAWINGS

The invention is illustrated in the accompanying drawings, in which the FIGURE shows, in the area to the left of the continuous line, the relationship between the surface area and the DBP absorption of the class of carbon blacks defined above, and of the specific carbon blacks used in the Examples and Comparative Examples given below.

DESCRIPTION OF THE PREFERRED EMBODIMENTS OF THE INVENTION

As briefly indicated in the Summary of the Invention above, our researches into the voltage stability of conductive polymer compositions containing carbon black, have discovered that the voltage stability is critically dependent on the type of carbon black (including whether or not it has been annealed) and the type of polymer in which it is dispersed.

The polymer should be a crystalline copolymer which consists essentially of units derived from at least one olefin, preferably ethylene and at least 10% by weight, based on the weight of the copolymer, of units derived from at least one olefinically unsaturated comonomer containing a polar group, preferably an acrylate ester, e.g. methyl acrylate, ethyl acrylate, or vinyl acetate, or acrylic or methacrylic acid. The term "crystalline" is used herein to mean that the polymer has a crystallinity of at least 1%, preferably at least 3%, especially at least 10%. Increasing polar comonomer content leads to reduced crystallinity, and the polar comonomer content is preferably not more than 30%. The Melt Index of the copolymer is preferably less than 20, especially less than 10. The higher the Melt Index, the more necessary it is that the composition should be cross-linked to a relatively high level, especially when the composition is prepared by a process in which annealing is used to decrease the resistivity of the composition. Thus the composition should have a gel fraction of at least 0.6 when the copolymer has a melt index of more than 20 and the composition has been annealed so that $$2L+5\log_{10}R\leqq 45$$

where L is the content of carbon black in percent by weight, based on the weight of the composition; and R is the resistivity of the composition at 25° C. in ohm.cm. Generally, it is desirable that the composition should have a resistivity of at least 80 ohm.cm.

When the composition comprises a polymer which serves as a matrix for the carbon-black-containing copolymer, i.e. for the dispersion of the carbon black in the copolymer, then the matrix polymer must have a higher softening point than the copolymer. Preferably the matrix polymer has limited compatibility for the copolymer, so that migration of the carbon black into the other polymer is minimised. Particularly suitable matrix polymers consist essentially of units derived from one or more olefins, e.g. high, medium or low density polyethylene. Other polymers which can be used comprise 50 to 100%, preferably 80 to 100%, by weight of $-CH_2CF_2-$ or $-CH_2CHCl-$ units, and in compositions which are not annealed, polymers which contain at least 50%, preferably at least 80%, of units derived from one or more olefins together with suitable comonomers.

The carbon black should have a particle size greater than 18 millimicrons, a d-spacing more than 360 (measured as described above, and the surface area (A) should be related to the DBP absorption (s) so that $$A < 1.2S + e^{S/50}$$

It should be noted (see in particular the accompanying drawings) that this definition excludes the acetylene blacks and the blacks of high surface area and structure hitherto recommended for conductive compositions, especially such compositions for use in electrical devices comprising an element composed of a conductive polymer (generally a PTC element) and at least two electrodes adapted to be connected to an external source of power so as to cause an electrical current to pass through the element. Suitable blacks for use in the invention include furnace blacks, thermal blacks and channel blacks.

The content of carbon black may be relatively low, e.g. not more than 12 or 15%, in which case it is preferred that the composition should be annealed, prior to cross-linking, at a temperature above the melting point of the copolymer, and preferably above the melting point of the highest-melting polymer in the composition, so as to decrease its resistivity. Typically the composition will be annealed so that $$2L + 5 \log_{10} R \leqq 45$$

Alternatively, the content of carbon black may be relatively high, e.g. above 15%, in which case annealing prior to cross-linking may be unnecessary, or may be for a limited time such that, at the end of the annealing, $$2L + 5 \log_{10} R < 45.$$

In such compositions the particle size of the carbon black is preferably greater than 30 millimicrons. It is often advantageous, whether or not the composition has been annealed before cross-linking, to heat the cross-linked composition for a short period at a temperature above its melting point.

The term "cross-linked" is used herein to connote any means of forming bonds between polymer molecules, both directly or through the mediation of another small or large molecule or solid body, provided only that such bonds result in coherency of the article and a degree of form stability throughout the operating or service temperature range of the composition. Thus in the compositions of the invention the polymer molecules can be linked together indirectly through mutual attachment by chemical or strong physical bonding to a third solid body, for example to the surface of the carbon black, or directly linked to each other by chemical bonding or indirectly linked to each other by mutual attachment by chemical bonding to another small or large molecule. Cross-linking of the compositions is often carried out after the compositions have been shaped, eg. by melt-extrusion, by methods well known in the art, preferably with the aid of ionising radiation or an organic peroxide. Preferably the composition is cross-linked at least to an extent equal to that induced by exposure to ionising radiation to a dosage of at least 0.75 M, where M is the Melt Index of the copolymer, e.g. to a gel fraction of at least 0.6.

The compositions of the invention may contain other ingredients which are conventional in the art, e.g. antioxidants, flame retardants, inorganic fillers, thermal stabilisers, processing aids and cross-linking agents or the residues of such ingredients after processing. The addition of a prorad (an unsaturated compound which assists radiation cross-linking) is often useful in improving stability, especially in unannealed products; suitable amounts of pro-rad are less than 10%, preferably 3 to 6%.

The compositions of the invention in which the only polymeric component is the copolymer (b) can be made by blending the ingredients in conventional mixing equipment at a temperature above the melting point of the copolymer, followed by annealing and cross-linking as desired. Alternatively, a master batch containing the carbon black and part of the copolymer can first be prepared, and the master batch then blended with the remainder of the copolymer. Similarly, when the composition contains a matrix polymer in which the carbon-black-containing copolymer is distributed, such compositions are made by blending the matrix polymer and a master batch of the carbon black in the copolymer, followed by annealing and cross-linking as desired. The master batch preferably contains 20 to 50%, e.g. 30 to 50% of the carbon black.

The invention is illustrated by the following Examples.

EXAMPLES

In the examples which follow, the test samples were prepared in accordance with the procedure described below unless otherwise stated. The ingredients for the master batches were milled together on a 2 roll mill, 10° to 30° C. above the melting point of the polymer. When used, additives were added before the carbon black. The preferred range of carbon black concentration in the master batch is 30 to 50% and most of the mixes prepared were in this range, although for some compositions loadings as low as 20 or as high as 70% were used. The carbon black master batch was milled together for five minutes then removed from the mill and either cooled to room temperature for subsequent use, or immediately let down into the matrix polymer to form the final blend. For the preparation of the final blend, the desired amount of master bath was fluxed on a 2 roll mill at a temperature 10°-30° C. higher than the melting temperature of the highest melting polymer in the final blend. The remaining constituents including the other polymer(s) were immediately added to the master batch and the mixture blended for five minutes. The amount of master batch was chosen to yield a resistance of about 10 kilo ohm in the test samples. The final blends were hydraulically pressed into 6×6×0.025 in. thick sheets at 40,000 p.s.i. and a temperature of at least 175° C. Samples 1×1.5 in. were cut from the slabs and 0.25 in. strips of conductive silver paint were coated on each end of the longest dimension to define a test area 1×1 in.

Where indicated prior to crosslinking, the above samples were annealed at 150° to 160° (200° for polypropylene) cyclically for up to two hour periods followed by cooling to room temperature until a minimum resistance level was reached. (Usually, two or three annealing cycles sufficed). Usually the samples were crosslinked by radiation, dosees used ranged from 6 to 50 Mrads with most samples receiving 12 Mrads.

Voltage stability was assessed by measuring the room temperature resistance of the sample before (Ri) and after (Rf) the sample had been subjected to a period of operation at high voltage stress. In most instances this involved operating the heater for 72 hours at 480 volts in ambient air, then disconnecting from the electricity source and cooling to room temperature before remeasurement. The voltage stability is expressed as the ratio of initial resistance to final resistance.

EXAMPLE I

It should be noted that the loading of master batch (and hence of carbon black) required to achieve a resistivity of 10 kilo ohms is very dependant on the processing conditions and on the carbon black type. To illustrate this, blends containing Sterling 50, Vulcan XC-72 and Black Pearls 880 were prepared as described above and using a 1 lb. Banbury mixer temperatures and times being the same in each experiment. The master batch polymer was an ethylene (18%) ethyl acrylate copolymer (DPD6169). The matrix or let-down polymer being a low density polyethylene (Alathon 34). The concentration of carbon (CB) in the master batch (MB) in each case was 36%. Table I shows the level of master batch and also the level of carbon black in the final blend required to achieve a sensitivity of 10 kilo ohms.

TABLE I

| Carbon Black | Two Roll mill | | Banbury mixer | |
|---|---|---|---|---|
| Name | % MB | % CB | % MB | % CB |
| Sterling 50 | 50 | 18 | 60 | 22 |
| Vulcan XC-72 | 40 | 14.4 | 50 | 18 |
| Black Pearls 880 | 40 | 14.4 | 40 | 14.4 |

EXAMPLE 2

A variety of carbon blacks were incorporated into a master batch using DPD6169 as the polymeric constituent and let down with Alathon 34 to achieve a resistance level after annealing and irradiation to 12 Mrads of 10 kilo ohms. The results of voltage stability tests on these samples are shown in Table II, in which the samples marked C are comparative Examples.

TABLE II

| | | | | | Annealed samples % | | Unannealed samples % | |
|---|---|---|---|---|---|---|---|---|
| Trade Name | ASTM code | mu | A $m^2/g$ | DBP cc/100 g | Carbon black | Ri/Rf | carbon black | Ri/Rf |
| 1. Sterling NS | N774 | 75 | 27 | 70 | 15.1 | 0.76 | | |
| 2. Philblack N765 | N765 | 60 | 30 | 116 | 11.1 | 0.56 | | |
| 3. Furnex N765 | N765 | 60 | 30 | 107 | 9.7 | 0.4 | | |
| 4. Sterling N765 | N765 | 60 | 30 | 116 | 9.11 | 0.58 | 16.2 | 0.63 |
| 5. Sterling V | N660 | 50 | 35 | 91 | 10.8 | 0.7 | | |
| 6. Sterling VH | N650 | 60 | 36 | 122 | 7.9 | 0.83 | | |
| 7. Statex N550 | N550 | 42 | 40 | 122 | 7.9 | 0.83 | | |
| 8. Sterling So-1 | N539 | 42 | 42 | 109 | 10.8 | 0.55 | | |
| 9. Sterling S0 | N550 | 42 | 42 | 120 | 9.7 | 0.6 | 18 | 0.63 |
| 10. Philblack N550 | N550 | 42 | 44 | 118 | 9.4 | 0.65 | | |
| 11. Regal 99 | N440 | 36 | 46 | 60 | 19.1 | 0.35 | | |
| C 12. Shewinigan Black | — | 42 | 64 | — | 15.1 | 0.004 | | |
| 13. Vulcan K | N351 | 28 | 70 | 124 | 10.8 | 0.47 | | |
| 14. Vulcan 3 | N330 | 27 | 80 | 103 | 10.1 | 0.48 | | |
| 15. Vulcan 3H | N347 | 26 | 90 | 124 | 7.9 | 0.38 | | |
| C 16. Regal 330 | N327 | 25 | 94 | 70 | 16.2 | 0.19 | | |
| 17. Vulcan 6H | N242 | 21 | 124 | 128 | 10.1 | 0.38 | | |
| C 18. Vulcan C | N293 | 23 | 145 | 100 | 11.9 | 0.29 | 16.2 | * |
| C 19. Vulcan SC | N294 | 22 | 203 | 106 | 10.1 | 0.24 | | |
| C 20. Black Pearls 880 | — | 16 | 220 | 110 | | | 1.41 | * |
| C 21. Vulcan XC-72 | N472 | 35 | 254 | 178 | 10.8 | 0.23 | | |
| C 22. Black Pearls 74 | — | 17 | 320 | 109 | 10.8 | * | | |
| 23. Ketjan black EX | — | 30 | 1000 | 3440 | 5.3 | 0.52 | | |

*Sample has such poor voltage stability that it burns.

EXAMPLE 3

A survey was made of a number of different polymers as the master batch or matrix polymer. The results are shown in Table 3.

TABLE 3

EFFECT OF POLYMER TYPE

| Copolymer in master batch | Commercial name and M.I. (g./10 min) | Polymer in final blend | Commercial name | Remarks |
|---|---|---|---|---|
| Ethylene (18%) ethyl acrylate | DPDA 61 81 M.I.-2.2 | Polyethylene 0.93 density | Alathon 34 M.I.-3 | Very similar results to those of Table II |
| Ethylene-(18%) ethyl acrylate | DPDA 9169 M.I.-20 | as above | as above | Very similar results to those |

TABLE 3-continued

EFFECT OF POLYMER TYPE

| Copolymer in master batch | Commercial name and M.I. (g./10 min) | Polymer in final blend | Commercial name | Remarks |
|---|---|---|---|---|
| | | | | of Table II |
| Ethylene-(6.6%) ethyl acrylate | DPD 7365 M.I.-8 | as above | as above | Voltage stability very poor with most carbon blacks |
| Ethylene-(5.5%) ethyl acrylate | DPD 7070 M.I.-8 | as above | as above | Voltage stability very poor with most carbon blacks |
| Ethylene-(18%) vinyl acetate | Alathon 3172 M.I.-8 | as above | as above | Very similar results to those of Table II |
| Ethylene-(28%) vinyl acetate | Alathon 3172 M.I.-6 | as above | as above | Very similar results to those of Table III |
| Ethylene-(30%) propylene | Vistalon 702 Mooney Visc. ~ 30 | as above | as above | Voltage stability very poor with most carbon blacks |
| Polyethylene 0.93 density | DYNH M.I.-2 | Polyethylene 0.96 density | Alathon 7030 M.I. 3 | |
| Ethylene-(18%) ethyl acrylate | DPD 6169 M.I.-6 | Polypropylene (High impact) | Profax 8623 M.I.-2 | Results very similar to Table II slightly different preferred range |
| Ethylene-(18%) ethyl acrylate | DPD 6169 | Vinylidine di Fluoride copolymer | Kynar 7201 M.I. 33 | Results similar to Table II |
| as above | as above | none | — | Results very similar to Table II |

We claim:

1. An electrical device comprising an element composed of a conductive polymer and at least two electrodes adapted to be connected to an external source of electrical power so as to cause an electrical current to pass through the element, said element being composed of a cross-linked conductive polymer composition which exhibits PTC behavior with an $R_{14}$ value of at least 2.5 and which comprises (a) conductive carbon black having a particle size greater than 18 millimicrons, a d-spacing greater than 360, and a surface area (A) which is less than $$1.2S+e^{S/50}$$

where S is the DBP absorption of the carbon black, said carbon black being present in amount at least 15% by weight of the composition and being dispersed in (b) at least one crystalline copolymer which consists essentially of units derived from at least one olefin and at least 10 weight %, based on the copolymer, of units derived from at least one olefinically unsaturated comonomer containing a polar group;

subject to the proviso that when (i) said crystalline copolymer (b) has a melt index of more than 20 and (ii) $2L+5\log_{10}R<45$ where L is the content of carbon black in percent by weight based on the weight of the composition and R is the resistivity of the composition at 25° C. in ohm.cm., said composition has a gel fraction of at least 0.6.

2. A device according to claim 1 wherein said carbon black has a particle size greater than 30 millimicrons.

3. A device according to claim 1 wherein said carbon black has a particle size of at most 75 millimicrons.

4. A device according to claim 1 wherein said composition has a gel fraction of at least 0.6.

5. A device according to claim 1 wherein said composition also comprises (c) at least one crystalline polymer which is selected from polymers consisting essentially of units derived from at least one olefin, polymers comprising at least 50% by weight of —$CH_2CHCl$— units and polymers comprising at least 50% by weight of —$CH_2CF_2$— units; which has a softening point higher than said copolymer (b); and which serves as a matrix for the carbon-black-containing copolymer (b).

6. A device according to claim 5 wherein said composition has a resistivity at 25° C. of 80 to $10^5$ ohm.cm.

7. A device according to claim 6 which comprises a pair of laminar electrodes having a said element in the form of a lamina therebetween.

8. A device according to claim 7 which comprises (1) an elongate element of a said composition;

(2) at least two longitudinally extending electrodes embedded in said composition parallel to each other; and (3) an outer layer of a protective and insulating composition.

9. A device according to claim 1 wherein said composition also comprises (c) at least one crystalline polymer which consists essentially of units derived from at least one olefin; which has a softening point higher than said copolymer (b); and which serves as a matrix for the carbon-black-containing copolymer (b).

10. A device according to claim 9 wherein said crystalline polymer (c) is polyethylene.

11. A device according to claim 10 wherein said crystalline copolymer (b) is a copolymer of ethylene and a polar comonomer selected from methyl acrylate, ethyl acrylate and vinyl acetate.

12. A device according to claim 9 wherein said crystalline copolymer (b) is a copolymer of ethylene and a polar comonomer selected from methyl acrylate, ethyl acrylate, vinyl acetate, acrylic acid and methacrylic acid.

13. A device according to claim 1 wherein the copolymer (b) is a copolymer of ethylene and vinyl acetate and wherein the conductive polymer composition also comprises polyethylene.

14. A device according to claim 13 which is a self-limiting heater and which comprises (1) an elongate element of a said composition;

(2) at least two longitudinally extending electrodes embedded in said composition parallel to each other; and (3) an outer layer of a protective and insulating composition.

15. A device according to claim 1 wherein the copolymer (b) is a copolymer of ethylene and ethyl acrylate and wherein the conductive polymer composition also comprises polyethylene.

16. A device according to claim 15 which is a self-limiting heater and which comprises (1) an elongate element of a said composition;

(2) at least two longitudinally extending electrodes embedded in said composition parallel to each other; and (3) an outer layer of a protective and insulating composition.

17. An electrical device comprising an element composed of a conductive polymer and at least two electrodes adapted to be connected to an external source of electrical power so as to cause an electrical current to pass through the element, said element being composed of a cross-linked conductive polymer composition which has a gel fraction of at least 0.6 and which comprises (a) a conductive carbon black having a particle size greater than 18 millimicrons, a d-spacing greater than 360, and a surface area (A) which is less than $$1.2S+e^{S/50}$$

where S is the DBP absorption of the carbon black, said carbon black being dispersed in (b) at least one crystalline copolymer which consists essentially of units derived from at least one olefin and at least 10 weight %, based on the copolymer, of units derived from at least one olefinically unsaturated comonomer containing a polar group; the content of carbon black in said composition being L% by weight and the resistivity of said composition at 25° C. being R ohm.cm, and R and L being such that $$2L+5\log_{10}R>45.$$

18. A device according to claim 17 wherein said carbon black has a particle size greater than 30 millimicrons.

19. A device according to claim 17 wherein said carbon black has a particle size of at most 75 millimicrons.

20. A device according to claim 17 wherein said composition also comprises (c) at least one crystalline polymer which is selected from polymers consisting essentially of units derived from at least one olefin, polymers comprising at least 50% by weight of $-CH_2CHCl-$ units and polymers comprising at least 50% by weight of $-CH_2CF_2$ units; which has a softening point higher than said copolymer (b); and which serves as a matrix for the carbon-black-containing copolymer (b).

21. A device according to claim 20 wherein said composition has a resistivity at 25° C. of 80 to $10^5$ ohm.cm.

22. A device according to claim 21 which comprises a pair of laminar electrodes having a said element in the form of a lamina therebetween.

23. A device according to claim 21 which is a self-limiting heater and which comprises (1) an elongate element of a said composition;

(2) at least two longitudinally extending electrodes embedded in said composition parallel to each other; and (3) an outer layer of a protective and insulating composition.

24. A device according to claim 17 wherein said composition also comprises (c) at least one crystalline polymer which consists essentially of units derived from at least one olefin; which has a softening point higher than said copolymer (b); and which serves as a matrix for the carbon-black-containing copolymer (b).

25. A device according to claim 24 wherein said crystalline polymer (c) is polyethylene.

26. A device according to claim 25 wherein said crystalline copolymer (b) is a copolymer of ethylene and a polar comonomer selected from methyl acrylate, ethyl acrylate and vinyl acetate.

27. A device according to claim 24 wherein said crystalline copolymer (b) is a copolymer of ethylene and a polar comonomer selected from methyl acrylate, ethyl acrylate, vinyl acetate, acrylic acid and methacrylic acid.

28. An electrical device comprising an element composed of a conductive polymer and at least two electrodes adapted to be connected to an external source of electrical power so as to cause an electrical current to pass through the element, said element being composed of a cross-linked conductive polymer composition which exhibits PTC behavior with an $R_{100}$ value at least 10 and which comprises (a) conductive carbon black having a particle size greater than 18 millimicrons, a d-spacing greater than 360, and a surface area (A) which is less than $$1.2S+e^{S/50}$$

where S is the DBP absorption of the carbon black, said carbon black being present in amount at least 15% by weight of the composition and being dispersed in (b) at least one crystalline copolymer which consists essentially of units derived from at least one olefin and at least 10 weight %, based on the copolymer, of units derived from at least one olefinically unsaturated comonomer containing a polar group;

subject to the proviso that when (i) said crystalline copolymer (b) has a melt index of more than 20 and (ii) $2L+5\log_{10}R\leqq 45$, where L is the content of carbon black in percent by weight based on the weight of the composition and R is the resistivity of the composition at 25° C. in ohm.cm, said composition has a gel fraction of at least 0.6.

29. A device according to claim 28 wherein said carbon black has a particle size greater than 30 millimicrons.

30. A device according to claim 28 wherein said carbon black has a particle size of at most 75 millimicrons.

31. A device according to claim 29 wherein said composition has a gel fraction of at least 0.6.

32. A device according to claim 27 wherein said composition also comprises (c) at least one crystalline polymer which is selected from polymers consisting essentially of units derived from at least one olefin, polymers comprising at least 50% by weight of —$CH_2CHCl$— units and polymers comprising at least 50% by weight of —$CH_2CF_2$— units; which has a softening point higher than said copolymer (b); and which serves as a matrix for the carbon-black-containing copolymer (b).

33. A device according to claim 32 wherein said composition has a resistivity at 25° C. of 80 to $10^5$ ohm.cm.

34. A device according to claim 33 which comprises a pair of laminar electrodes having a said element in the form of a lamina therebetween.

35. A device according to claim 33 which comprises (1) an elongate element of a said composition;

(2) at least two longitudinally extending electrodes embedded in said composition parallel to each other; and (3) an outer layer of a protective and insulating composition.

36. A device according to claim 28 wherein said composition also comprises (c) at least one crystalline polymer which consists essentially of units derived from at least one olefin; which has a softening point higher than said copolymer (b); and which serves as a matrix for the carbon-black-containing copolymer (b).

37. A device according to claim 36 wherein said crystalline polymer (c) is polyethylene.

38. A device according to claim 37 wherein said crystalline copolymer (b) is a copolymer of ethylene and a polar comonomer selected from methyl acrylate, ethyl acrylate and vinyl acetate.

39. A device according to claim 36 wherein said crystalline copolymer (b) is a copolymer of ethylene and a polar comonomer selected from methyl acrylate, ethyl acrylate, vinyl acetate, acrylic acid and methacrylic acid.

40. A self-limiting heater which comprises (1) an elongate element composed of a cross-linked conductive polymer composition which has a gel fraction of at least 0.6, which exhibits PTC behavior, which has a resistivity at 25° C. of 80 to 50,000 ohm.cm, and which comprises (a) a conductive carbon black having a particle size greater than 18 millimicrons, a d-spacing greater than 360, and a surface area (A) which is less than $$1.2S+e^{S/50}$$

where S is the DBP absorption of the carbon black, said carbon black being present in amount at least 15% by weight of the composition and being dispersed in (b) at least one crystalline copolymer which consists essentially of units derived from at least one olefin and at least 10 weight %, based on the copolymer, of units derived from at least one olefinically unsaturated comonomer containing a polar group and (c) at least one crystalline polymer which consists essentially of units derived from at least one olefin and which has a softening point higher than said co-polymer (b);

(2) at least two longitudinally extending electrodes embedded in said composition parallel to each other; and (3) an outer layer of a protective and insulating composition.

41. A heater according to claim 40 wherein the copolymer (b) is an ethylene/vinyl acetate copolymer and the polymer (c) is polyethylene.

42. A heater according to claim 41 wherein the copolymer (b) has a melt index less than 20.

43. A heater according to claim 41 wherein the copolymer (b) has a melt index less than 10.

44. A heater according to claim 40 wherein the copolymer (b) is an ethylene/ethyl acrylate copolymer and the polymer (c) is polyethylene.

45. A heater according to claim 44 wherein the copolymer (b) has a melt index less than 20.

46. A heater according to claim 44 wherein the copolymer (b) has a melt index less than 10.

47. A heater according to claim 40 wherein the carbon black is a furnace black.

48. A heater according to claim 40 wherein the carbon black is a thermal black.

49. A heater according to claim 40 wherein the carbon black is a channel black.

* * * * *